US006473588B2

(12) United States Patent
Nakamura

(10) Patent No.: US 6,473,588 B2
(45) Date of Patent: Oct. 29, 2002

(54) DEVELOPMENT ROLLER AND DEVELOPER UNIT USING THE SAME

(75) Inventor: Makoto Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/915,345

(22) Filed: Jul. 27, 2001

(65) Prior Publication Data

US 2002/0037184 A1 Mar. 28, 2002

(30) Foreign Application Priority Data

Jul. 27, 2000 (JP) ..... 2000-227048

(51) Int. Cl.[7] ..... G03G 15/08
(52) U.S. Cl. ..... 399/286; 399/279
(58) Field of Search ..... 399/53, 55, 265, 399/267, 270, 276, 279, 282, 285, 286; 347/140; 430/105, 120

(56) References Cited

U.S. PATENT DOCUMENTS

| | | | | |
|---|---|---|---|---|
| 4,899,689 A | * | 2/1990 | Takeda et al. | 399/286 |
| 5,122,838 A | * | 6/1992 | Kohyama | 399/279 X |
| 5,148,219 A | * | 9/1992 | Kohyama | 399/279 X |
| 6,035,172 A | * | 3/2000 | Mimura et al. | 399/286 |
| 6,154,627 A | * | 11/2000 | Iwamatsu et al. | 399/286 |

FOREIGN PATENT DOCUMENTS

| | | |
|---|---|---|
| JP | 7-92793 | 4/1995 |
| JP | 10-115979 | 5/1998 |
| JP | 11-84859 | 3/1999 |
| JP | 11-184244 | 7/1999 |
| JP | 2000-10403 | 1/2000 |
| JP | 2000-112225 | 4/2000 |

* cited by examiner

*Primary Examiner*—Sandra Brase
(74) *Attorney, Agent, or Firm*—Oblon, Spivak, McClelland, Maier & Neustadt, P.C.

(57) ABSTRACT

A development roller has a core shaft and an external composite layer provided around the core shaft, the external composite layer including an elastic layer and a surface layer which are successively overlaid on the core shaft in that order, the development roller having a volume resistivity of $1.5\times10^4$ Ω·cm or less and an electrostatic capacity of $1.5\times10^{-4}$ F/m$^2$ or more. A developer unit is provided with the above-mentioned development roller which is disposed so as to have a toner deposited on an image portion formed on a surface of a photoconductor, a toner supply roller which is disposed opposite to the development roller and is capable of forming therearound a magnetic brush of the toner and a carrier, and brings the magnetic brush into contact with the development roller to supply the toner to the development roller, and a doctor blade disposed in contact with the surface of the toner supply roller to regulate the thickness of a layer of the toner.

8 Claims, 3 Drawing Sheets

FIG. 5 CONVENTIONAL
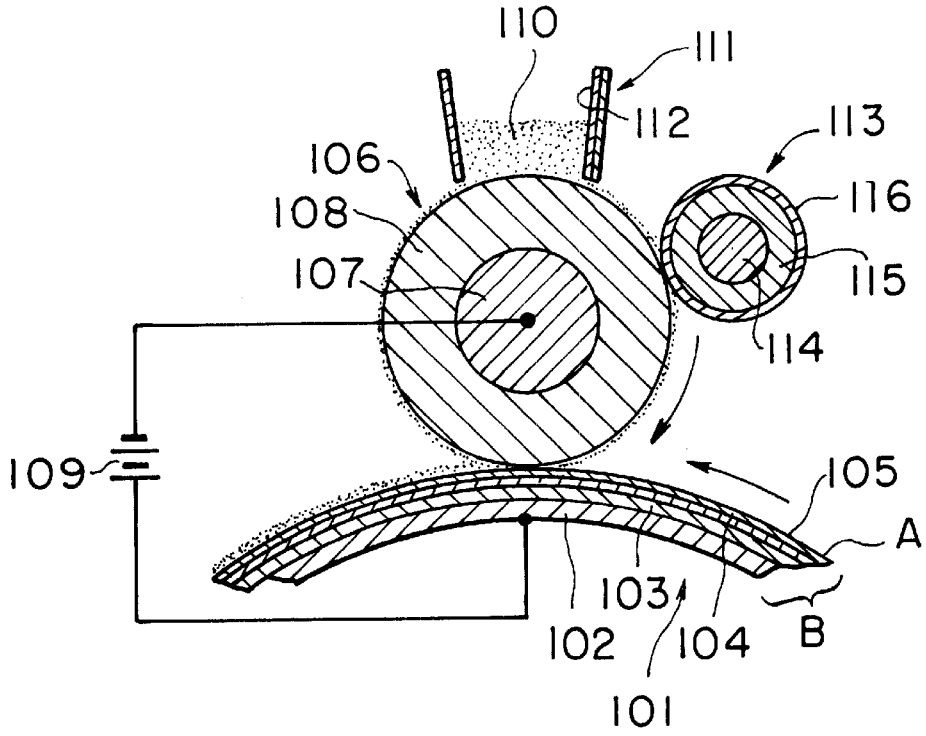
FIG. 6 CONVENTIONAL
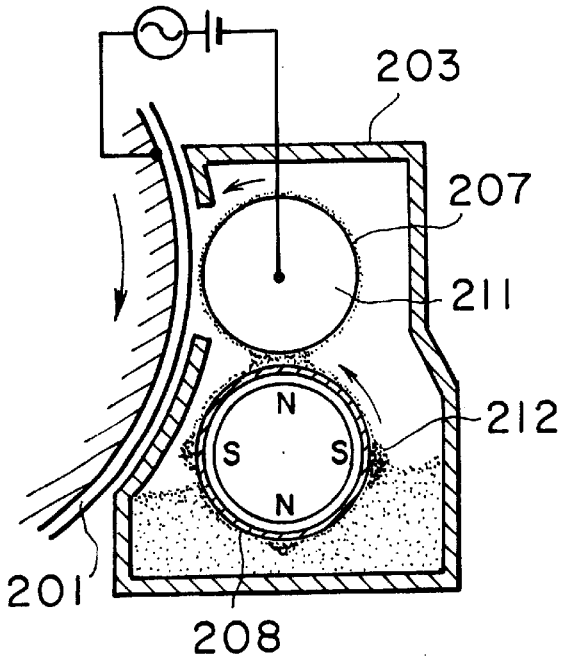

DEVELOPMENT ROLLER AND DEVELOPER UNIT USING THE SAME

BACKGROUND OF THE INVENTION

1. Field of the Invention

The present invention relates to a development roller and a developer unit employing the development roller, designed for electrophotographic image forming apparatus such as copying machines, printers, and facsimile machines.

2. Discussion of Background

There is a tendency to simplify the maintenance of electrophotographic image forming apparatus such as copying machines, printers, and facsimile machines, in particular, small-sized units. For this purpose, a developer unit for developing latent electrostatic images formed on an image-bearing member such as a photo-conductor, sensitized paper, or recording sheet using a mono-component developer is disclosed in Japanese Laid-Open Patent Application 53-3233. In fact, that kind of developer unit has been put to practical use.

FIG. 5 is a schematic view showing one embodiment of such a conventional development unit. In FIG. 5, reference numeral 101 indicates a photoconductor drum, which comprises a surface layer portion A and a base member B. The surface layer portion A serves as an image-bearing member. In the base member B, which is provided with a function of supporting the image-bearing member A, an electroconductive rubber layer 103 with relatively large elasticity and a flexible metal foil layer 104 such as an aluminum foil are successively attached to a metallic drum 102. The surface layer portion A comprises a photoconductive insulator layer 105, which is formed by, for example, depositing a metal such as selenium on the metal foil layer 104 of the base member B.

A development roller 106 is brought into pressure contact with the surface of the above-mentioned photo-conductor drum 101. The development roller 106 comprises a metallic core roll 107 and an elastic layer 108 which is provided around the metallic core roll 107 and made of a synthetic rubber or urethane foam, designed to have electroconductivity.

This type of conventional developer unit has the problem that a plasticizer and low-molecular-weight material contained in the elastic layer 108 of the development roller 106 may cause bleeding therefrom and contaminate the surface layer portion A of the photo-conductor drum 101. Further, toner particles are undesirably attached to the surface of the elastic layer 108 of the development roller 106 as a result of the phenomena of tacking and filming, As a countermeasure against such problems, it is proposed to coat the elastic layer 108 of the development roller 106 with a surface layer (not shown) comprising a resin that is readily releasable from the toner. The above-mentioned proposal is made to prevent the bleeding of the plasticizer or low-molecular-weight material from the elastic layer of the development roller, and at the same time, to prevent the tacking and filming of toner to the development roller.

A bias source 109 is connected across the core roller 107 of the development roller 106 and the base member B of the photoconductor drum 101. Above the development roller 106, a hopper 111 containing a mono-component nonmagnetic toner 110 is disposed with an opening at the bottom of the hopper 111 being positioned at a predetermined distance from the surface of the development roller 106. A triboelectric charging member 112 is attached to the inner wall on the right side of the hopper 111. A toner layer formed around the development roller 106 is leveled by a leveling member 113 in such a configuration that the surface of the leveling member 113 is brought into pressure contact with the surface of the development roller 106. The leveling member 113, which is prepared by successively attaching a rubber layer 115 and a triboelectric charging layer 116 onto a metallic roll 114, is not rotatably mounted, but fixed.

According to the development process effected by the developer unit of FIG. 5, a thin toner layer retained on the surface of the development roller 106 is brought into contact with the photoconductor drum 101 bearing latent electrostatic images thereon. The toner is transferred to the photoconductor drum 101 in accordance with the development field, so that the latent electrostatic images are developed and made into visible toner images. In the case of the development roller 106 of FIG. 5, the polarity and the charge quantity of the toner 110 are controlled by triboelectric charging, that is, by the contact of the toner with the triboelectric charging member 112 and the contact of the toner with the triboelectric charging layer 116 of the toner supply layer 113. The toner 110 is selectively transferred from the development roller 106 to the photoconductor drum 101 depending upon the polarity of the charged toner and the development field on the photoconductor drum 101. Namely, the toner 110 is selectively deposited on an image portion determined by the latent electrostatic images formed on the photoconductor drum 101. The development unit as shown in FIG. 5 has the advantage that color toners are available for achieving color image formation because a magnetic material is not necessary for preparation of the toner composition.

Japanese Patent Publication 64-1022 discloses another developer unit. This development unit employs a mono-component non-magnetic toner and is designed to feed a development roller with the toner by means of a magnetic brush.

FIG. 6 is a schematic cross sectional view showing one embodiment of the above-mentioned conventional developer unit.

In a developer unit 203 shown in FIG. 6, as a magnetic roller 208 is driven in rotation in the direction indicated by the arrow, a magnetic carrier is magnetically attracted to the magnetic roller 208 so as to charge non-magnetic toner particles. A magnetic brush 212 is thus formed around the magnetic roller 208. A development roller 211 stands between the magnetic roller 208 and an electrostatic-image-bearing member 201. Charged toner particles 207 electrostatically clinging to the magnetic brush 212 are separated therefrom and supported by the development roller 211 in order to develop an electrostatic image formed on the electrostatic-image-bearing member 201. Namely, the non-magnetic toner particles 207 can be shifted from the magnetic brush 212 to the development roller 211 by the action of an alternating field formed between the magnetic roller 208 and the development roller 211. In the developer unit 203, the toner is initially charged by the principle of two-component development, and the charged toner 207 is carried to the development roller 211 by the magnetic brush 212 formed around the magnetic roller 208. Such a development system requires no member coming in contact with the development roller 211, thereby reducing the stress applied to the toner particles 207 deposited on the development roller 211. This makes it possible to secure the developer unit 203 in the image forming apparatus without any replacement.

The conventional developer unit as shown in FIG. 5 produces various problems, as mentioned above. Namely, toner particles are deposited on the surface of the leveling member for regulating the toner thin layer, in particular when the leveling member is in the form of a blade. The toner filming is caused around the development roller. Further, the surface of the development roller readily exhibits stripe-like scratches with time. Furthermore, the toner is caused to deteriorate because of the application of stress thereto, with a result that the charge quantity of toner and the deposition amount of toner on the development roller change with time. In addition, toner deposition on the background takes place at the time of replenishment of toner. In consideration of occurrence of those problems, the developer unit has been necessarily designed as a detachable cartridge that can be replaced after several tens of thousands of prints have been made. To secure the development unit has been found to be impossible.

To solve the above-mentioned problems, the developer unit of FIG. 6 is proposed. However, when the developer unit of FIG. 6 is employed, the photoconductor drum must be charged to a considerably high surface potential, which will shorten the life of the photoconductor drum. Then, some trials are made to decrease the surface potential of the photoconductor drum at the charging step in order to prevent the photoconductor drum from deteriorating. With a decrease in charging potential of the photoconductor drum, the developing bias to be set is necessarily lowered.

Further, in light of the stability in forming dot images, a toner image may be reproduced by a two-valued modulation system, not a multi-valued modulation system. The two-valued system modulates the image pattern using two gradations, that is, presence or absence of a dot, with the density of every dot being the same. According to the multi-valued system, the image pattern is modulated using multiple gradations. However, use of the multi-valued system makes it difficult to obtain high quality image.

In the case where a dot image is reproduced by the two-valued modulation system, a characteristic curve of the print density of a dot image with respect to the electrostatic potential of a latent electrostatic image is required to have a gradient as steep as possible. The above-mentioned gradient will be referred to as "development $\gamma$" in the present invention. At the same time, it is required to make the difference between the surface potential of an image portion on the photo-conductor and the developing bias as small as possible, The above-mentioned difference will be referred to as a development potential.

SUMMARY OF THE INVENTION

Accordingly, it is a first object of the present invention to provide a development roller capable of successfully performing a development step with the development $\gamma$, ie, the gradient of the above-mentioned characteristic curve being made rather steep, and the amount of toner to be deposited on the image portion of the photoconductor being maximized at the development potential of 150 V or less.

A second object of the present invention is to provide a developer unit employing the above-mentioned development roller.

The first object of the present invention can be achieved by a development roller comprising a core shaft and an external composite layer provided around the core shaft, the external composite layer comprising an elastic layer and a surface layer which are successively overlaid on the core shaft in that order, with the development roller having a volume resistivity of $1.5\times10^4$ Ω·cm or less and an electrostatic capacity of $1.5\times10^{-4}$ F/m$^2$ or more.

The second object of the present invention can be achieved by a developer unit comprising the above-mentioned development roller which is disposed so as to have a toner deposited on an image portion formed on a surface of a photoconductor, a toner supply roller which is disposed opposite to the development roller and is capable of forming therearound a magnetic brush comprising the toner and a carrier, and brings the magnetic brush into contact with the development roller to supply the toner to the development roller, and a doctor blade disposed in contact with the surface of the toner supply roller to regulate the thickness of a layer of the toner.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 5 is a schematic cross sectional view showing one embodiment of the conventional developer unit.

FIG. 6 is a schematic cross sectional view showing another embodiment of the conventional developer unit.

DESCRIPTION OF THE PREFERRED EMBODIMENTS

A development roller of the present invention comprises a core shaft and an external composite layer provided around the core shaft. The external composite layer comprises an elastic layer and a surface layer which are successively overlaid on the core shaft in that order. The development roller has a volume resistivity of $1.5\times10^4$ Ω·cm or less and an electrostatic capacity of $1.5\times10^{-4}$ F/m$^2$ or more. By using the above-mentioned development roller, the gradient of the above-mentioned characteristic curve showing the relationship between development potential and development ratio, which will be described in detail, can be made steep. Further, the amount of toner deposited on an image portion of the photoconductor can be maximized at the development potential of 150 V or less.

Figure 1:
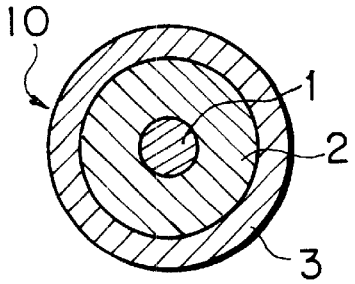
FIG. 1 is a cross sectional view showing one embodiment of a development roller according to the present invention.

FIG. 1 is a schematic cross sectional view showing one embodiment of a development roller of the present invention.

In FIG. 1, a development roller 10 comprises a core shaft 1 made of a metal, an elastic layer 2 which is provided around the core shaft 1, and a surface layer 3 overlaid on the elastic layer 2.

The elastic layer 2 comprises a rubber or elastomer. Specific examples of the rubbers and elastomers for use in the elastic layer 2 include ethylene propylene rubber, butadiene rubber, nitrile rubber, styrene rubber, isoprene rubber, silicone rubber, urethane rubber, and urethane foam.

The nip width between the development roller 10 and a photoconductor needs appropriate adjustment for the improvement of reproduction performance of dot images. To obtain a proper nip width, it is preferable that an external composite layer including the elastic layer 2 and the surface layer 3 have a hardness of 25 to 50 degrees in terms of a JIS-A scale (Japanese Industrial Standards).

On the outer surface of the elastic layer 2 lies the surface layer 3 comprising a resin composition. For example, the above-mentioned resin composition may be prepared by adding an electroconductivity-imparting agent to a solvent-soluble fluoroplastic, ie, a copolymer of fluoroolefin and ethylenic unsaturated monomer. The above resin composition is just given as an example, and other resin compositions may be used as long as they are not incompatible with the object of the present invention. The surface layer 3 can be provided by conventional coating methods such as dip coating, spray coating, and roll coating. Or, a tube-molded form may be coated around the outer surface of the elastic layer 2 to provide a surface layer 3.

It is preferable that the surface layer 3 have a thickness of 30 $\mu$m or less. If the surface layer 3 is formed with a thickness of more than 30 $\mu$m using the above-mentioned resin composition material, the hardness of the surface layer 3 will necessarily become higher than that of the elastic layer 2. In this case, the surface layer 3 will easily crack.

It is preferable that the external composite layer including the elastic layer 2 and the surface layer 3 show a hardness of 55 degrees or less, more preferably 50 degrees or less, in terms of ASKER C hardness in accordance with JIS K 6253 under application of a load of 303 g. To improve the reproduction performance of dot images, the surface layer 3 is required to have a proper hardness. In light of this point, it is preferable that the surface layer 3 of the development roller 10 have a hardness of 50 degrees or less under application of a load of 303 g in terms of ASKER C hardness.

The electric characteristics of the development roller 10 feature in the present invention. The development roller of the present invention have a volume resistivity of $1.5\times10^4$ $\Omega\cdot$cm or less and an electrostatic capacity of $1.5\times10^{-4}$ F/m$^2$ or more. With the aim of extending the life of the electrophotographic image forming system, in particular, the life of the photoconductor, some attempts are made to reduce the charging potential of the photoconductor so that deterioration of the photoconductor can be minimized. A decrease in developing bias is necessarily accompanied by a decrease in charging potential of the photoconductor. Further, use of the two-valued modulation method for image pattern instead of the multi-valued modulation requires the development $\gamma$, ie, the gradient, to be steep. Such demands can be met by the electric characteristics of the development roller as specified In addition, the electroconductivity-imparting agent such as carbon black or a metallic oxide is added to the surface layer of the development roller because electroconductivity is required for the development roller.

Figure 2:
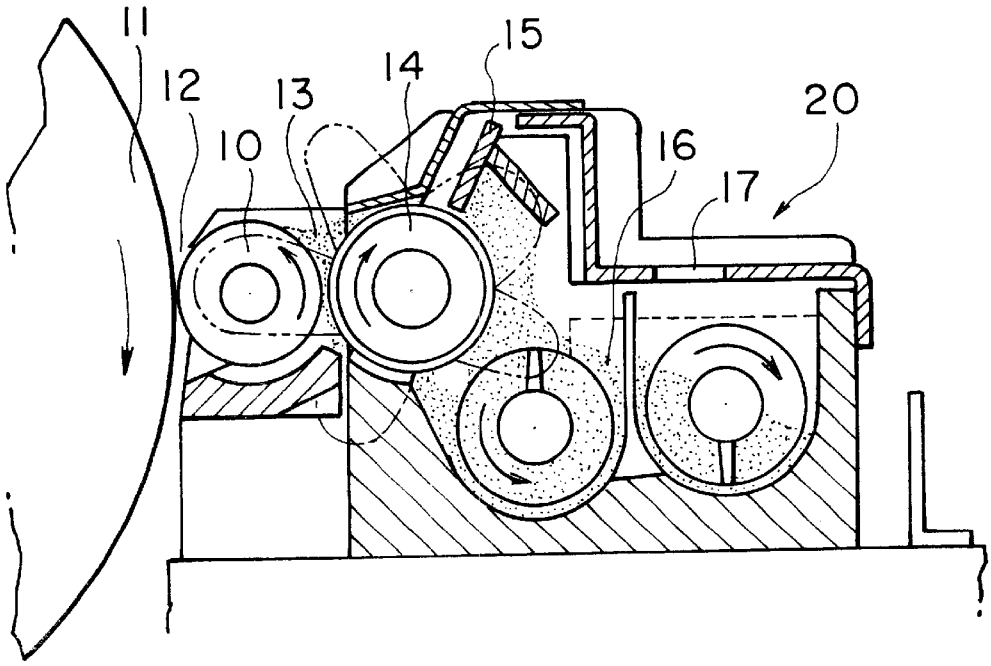
FIG. 2 is a schematic cross sectional view showing one embodiment of a developer unit employing the development roller illustrated in FIG. 1.

FIG. 2 is a schematic cross sectional view showing one embodiment of a developer unit using the development roller 10 of FIG. 1.

In a developer unit 20 of FIG. 2, a development roller 10 of the present invention is disposed in contact with the surface of a photoconductor drum 11. A toner supply roller 14, that is a magnetic roller, is disposed opposite to the development roller 10, with a doctor blade 15 coming in contact with the surface of the toner supply roller 14. A two-component developer 16 fed to the toner supply roller 14 is regulated to form a thin layer around the toner supply roller 14 with a predetermined thickness by the action of the doctor blade 15. Thus, a magnetic brush composed of a carrier and a toner is formed around the toner supply roller 14. While travelling around, the magnetic brush is brought into contact with the development roller 10 at a gap 13 between the toner supply roller 14 and the development roller 10. At the gap 13, the toner is separated from the magnetic brush and only the toner is transferred to the development roller 10 for forming a toner thin layer on the development roller 10. Reference numeral 17 indicates a toner replenishment section.

The toner transferred to the development roller 10 is carried toward a development zone 12, where the toner is deposited on an electrostatic latent image portion formed on the surface of the photoconductor drum 11. Thus, a latent image can be developed to be a visible toner image.

The toner supply roller 14 is not in contact with the development roller 10. The development roller 10 may be in contact or out of contact with the photoconductor drum 11. The contact development is preferable in light of quality of the obtained toner images.

Using a power source (not shown in FIG. 2), a bias voltage is applied across the toner supply roller 14 and the development roller 10, and across the development roller 10 and the photoconductor drum 11. The developing bias applied to the development roller 10 may be direct current or direct-current-superposed alternating current. The former is preferable in view of the cost.

In the above-mentioned embodiment shown in FIG. 2, the photoconductor in the form of a drum is employed. A belt-shaped photoconductor may also be used.

By using the developer unit 20 as shown in FIG. 2, the number of members coming in contact with the development roller 10 can be reduced, so that the conventional problem of toner filming on the development roller can be prevented. Further, it becomes possible to prevent adhesion of toner to the blade, which would be caused in the developer unit where the blade is brought into contact with the development roller.

The developer unit 20 of the present invention is designed so that the amount of toner particles to be deposited on the image portion formed on the photoconductor may be maximized when the development potential, that is, the difference between the surface potential of the image portion on the photoconductor and the developing bias is 150 V or less.

Other features of this invention will become apparent in the course of the following description of exemplary embodiments, which are given for illustration of the invention and are not intended to be limiting thereof.

EXAMPLE 1

In a liquid silicone rubber, electroconductive carbon black particles were dispersed with an amount ratio of 10 wt.%. The resultant mixture was cast in a casting mold in which a core shaft had been set in advance. After the silicone rubber was vulcanized under application of heat, the molded silicone rubber was subjected to external grinding, so that an elastic layer coated roll with a diameter of 16 mm was obtained.

After a primer was coated on the outer surface of the elastic layer, a solvent-soluble fluorine-containing resin, that is, a copolymer of a fluoroolefin and an ethylenic unsaturated monomer, with carbon black being dispersed in the resin was sprayed onto the primer-coated surface. Thus, a surface layer with a thickness of 20 μm was provided around the elastic layer.

Thus, a development roller No. 1 according to the present invention was obtained.

EXAMPLE 2

In a mixture of polyol and isocyanate, electro-conductive carbon black particles were dispersed with an amount ratio of 10 wt.%. The resultant mixture was cast in a casting mold in which a core shaft had been set in advance. After the mixture of polyol and isocyanate was vulcanized under application of heat, the molded material was subjected to external grinding, so that an elastic layer coated roll with a diameter of 16 mm was obtained.

Thereafter, a carbon-black dispersed aqueous urethane was sprayed onto the elastic layer. Thus, a surface layer with a thickness of 25 μm was provided around the elastic layer.

Thus, a development roller No. 2 according to the present invention was obtained.

Comparative Example 1

In a mixture of polyol and isocyanate, electro-conductive carbon black particles were dispersed with an amount ratio of 5 wt.%. The resultant mixture was cast in a casting mold in which a core shaft had been set in advance. After the mixture of polyol and isocyanate was vulcanized under application of heat, the molded material was subjected to external grinding, so that an elastic layer coated roll with a diameter of 16 mm was obtained.

After a primer was coated on the outer surface of the elastic layer, a solvent-soluble fluorine-containing resin, that is, a copolymer of a fluoroolefin and an ethylenic unsaturated monomer, with carbon black being dispersed in the resin was sprayed onto the primer-coated surface. Thus, a surface layer with a thickness of 20 μm was provided around the elastic layer.

Thus, a comparative development roller No. 1 was obtained. Comparative Example 2

In a liquid silicone rubber, electroconductive carbon black particles were dispersed with an amount ratio of 10 wt.%. The resultant mixture was cast in a casting mold in which a core shaft had been set in advance. After the silicone rubber was vulcanized under application of heat, the molded silicone rubber was subjected to external grinding, so that an elastic layer coated roll with a diameter of 16 mm was obtained.

Thereafter, a carbon-black dispersed aqueous urethane was sprayed onto the elastic layer. Thus, a surface layer with a thickness of 25 μm was provided around the elastic layer.

Thus, a comparative development roller No. 2 was obtained.

The volume resistivity, electrostatic capacity, hardness in terms of a JIS-A scale (Japanese Industrial Standards), and hardness in terms of ASKER C hardness in accordance with JIS K 6253 of the development rollers obtained in Examples 1 and 2 and Comparative Examples 1 and 2 were measured.

Figure 3:
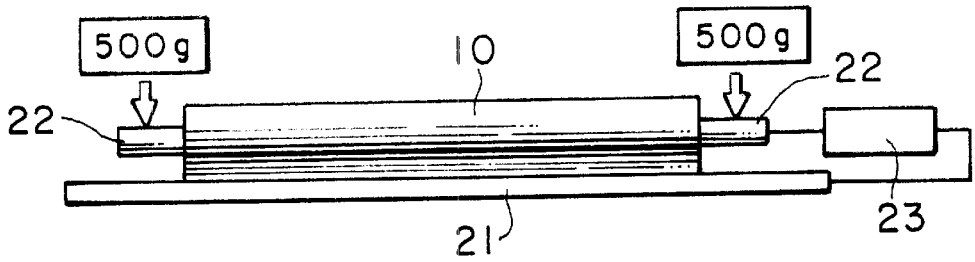
FIG. 3 is a schematic diagram in explanation of the method of measuring the volume resistivity and the electrostatic capacity of the development roller.

The above-mentioned volume resistivity and electrostatic capacity of each development roller were measured as illustrated in FIG. 3.

In FIG. 3, a development roller 10 was placed on a plate electrode 21, with a load of 500 g being applied to each end of a core shaft 22 toward the plate electrode 21. Upon application of 5 V across one end of the shaft 22 and the plate electrode 21, the volume resistivity of the development roller 10 was measured with a measuring instrument 23. In the same manner as in above, the electrostatic capacity of the development roller 10 was measured by setting an LCR meter as the measuring instrument 23.

The results are shown in TABLE 1.

Furthermore, each of the development rollers obtained in Examples and Comparative Examples was set in a developer unit as shown in FIG. 2. With the development potential, ie, the difference between the surface potential of an image portion on the photoconductor and the developing bias applied to the development roller being varied, a weight of the toner deposited on a unit area of the image portion on the photoconductor was measured. The obtained weight of toner was divided by a weight of toner per unit area of a toner thin layer on the development roller, The ratio thus calculated is referred to as a development ratio in the present invention. For instance, the development ratio of 100% means that all the toner per unit area on the development roller is completely used for development.

Figure 4:
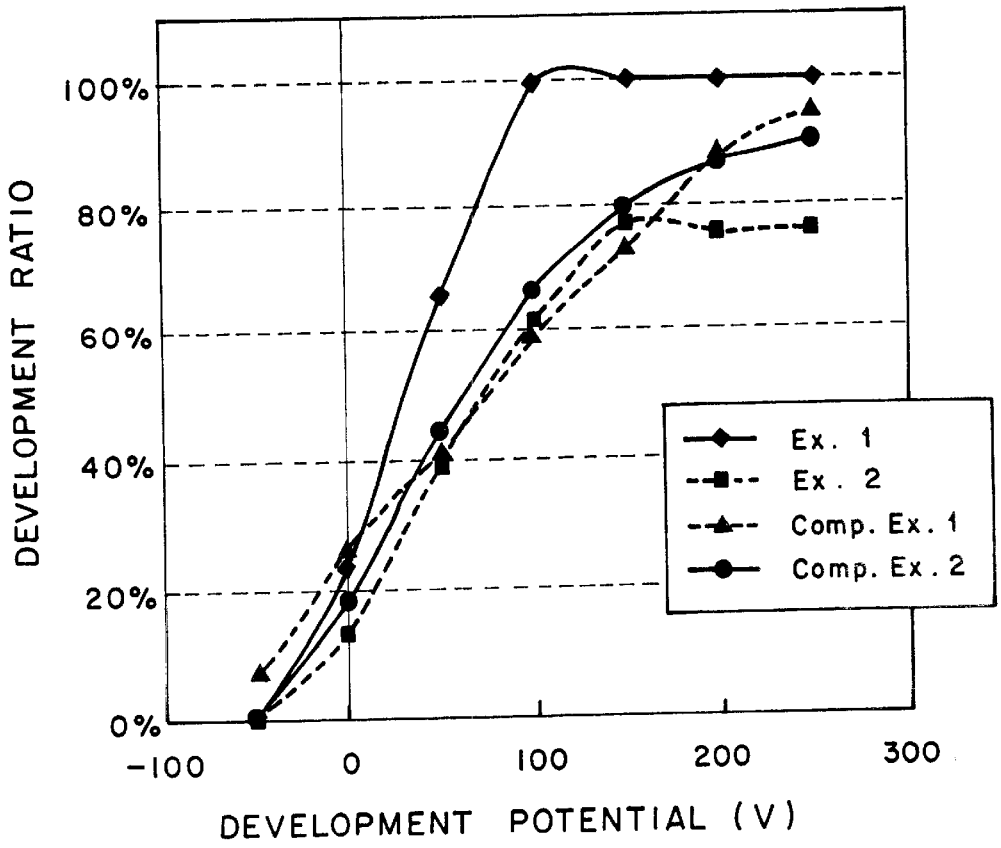
FIG. 4 is a graph showing the relationship between the development potential (V) and the development ratio (%) obtained in Examples 1 and 2 and Comparative Examples 1 and 2.

The relationship between the development potential and the development ratio was examined. The results are shown in FIG. 4. From the graph shown in FIG. 4, when the development ratio is maximized at the development potential of 150 V or less, a mark "o" is placed in TABLE 1. When the development ratio is not maximized at 150 V or less, a mark "x" is placed in TABLE 1.

Furthermore, after completion of the development, the dot image obtained on the photoconductor was transferred to a sheet, and the reproduction performance of the dot image was evaluated. In TABLE 1, "o" means excellent reproduction performance, and "x" means poor reproduction performance.

TABLE 1

| | Volume Resistivity (Ω·cm) | Electrostatic Capacity ($F/m^2$) | JIS-A Hardness (degree) | ASKER-C Hardness (degree) | Saturation of Development γ | Dot Reproduction |
|---|---|---|---|---|---|---|
| Ex. 1 | $1.17 \times 10^4$ | $2.11 \times 10^{-4}$ | 32 | 47 | o | o |
| Ex. 2 | $5.50 \times 10^3$ | $1.60 \times 10^{-4}$ | 46 | 50 | o | o |
| Comp. Ex. 1 | $7.78 \times 10^8$ | $4.59 \times 10^{-7}$ | 59 | 55 | x | x |
| Comp. Ex. 2 | $1.31 \times 10^5$ | $3.51 \times 10^{-7}$ | 20 | 43 | x | x |

Japanese Patent Application No. 2000-227048 filed Jul. 27, 2000 is hereby incorporated by reference.

What is claimed is:

1. A development roller comprising a core shaft and an external composite layer provided around said core shaft, said external composite layer comprising an elastic layer and a surface layer which are successively overlaid on said core shaft in that order, said development roller having a volume resistivity of $1.5\times10^4$ Ω·cm or less and an electrostatic capacity of $1.5\times10^{-4}$ $F/m^2$ or more.

2. The development roller as claimed in claim 1, wherein said external composite layer has a hardness of 25 to 50 degrees in terms of a JIS-A scale.

3. The development roller as claimed in claim 1, wherein said surface layer has a thickness of 30 μm or less, and said external composite layer has a hardness of 55 degrees or less in terms of ASKER-C hardness under the application of a load of 303 g.

4. A developer unit comprising:

a development roller which is disposed so as to have a toner deposited on an image portion formed on a surface of a photoconductor, a toner supply roller which is disposed opposite to said development roller and is capable of forming therearound a magnetic brush comprising said toner and a carrier, and brings said magnetic brush into contact with said development roller to supply said toner to said development roller, and a doctor blade disposed in contact with the surface of said toner supply roller to regulate the thickness of a layer of said toner, wherein said development roller comprises a core shaft and an external composite layer provided around said core shaft, said external composite layer comprising an elastic layer and a surface layer which are successively overlaid on said core shaft in that order, with said development roller having a volume resistivity of $1.5\times10^{4}$ Ω·cm or less and an electrostatic capacity of $1.5\times10^{-4}$ F/m$^2$ or more.

5. The developer unit as claimed in claim 4, wherein said external composite layer for use in said development roller has a hardness of 25 to 50 degrees in terms of a JIS-A scale.

6. The developer unit as claimed in claim 4, wherein said surface layer of said development roller has a thickness of 30 μm or less, and said external composite layer has a hardness of 55 degrees or less in terms of ASKER-C hardness under the application of a load of 303 g.

7. The developer unit as claimed in claim 4, wherein when a difference between a surface potential of said image portion and a developing bias is 150 V or less, the amount of said toner deposited on said image portion of said photoconductor is maximized.

8. The developer unit as claimed in claim 4, wherein said development roller is in contact with said photoconductor.

* * * * *